US005197713A

United States Patent [19]

Strosnider

[11] Patent Number: 5,197,713

[45] Date of Patent: Mar. 30, 1993

[54] PIPE PUSHING APPARATUS

[76] Inventor: Greg Strosnider, 254 Flower Dr., Folsom, Calif. 95630

[21] Appl. No.: 879,290

[22] Filed: May 7, 1992

[51] Int. Cl.[5] ..... E21B 19/00

[52] U.S. Cl. ..... 254/29 R

[58] Field of Search ..... 254/29 R, 30, 93 R; 403/287

[56] References Cited

U.S. PATENT DOCUMENTS 2,991,974 7/1961 Bingham ..... 254/29 R 3,207,326 9/1965 Enix ..... 254/29 R 3,347,521 10/1967 Bingham ..... 254/29 R

*Primary Examiner*—Robert C. Watson

*Attorney, Agent, or Firm*—Leon Gilden

[57] ABSTRACT

An apparatus including an elongate base having a first hydraulic cylinder to pivotally direct clamp members laterally of the base. A second hydraulic cylinder includes a cylinder rod and piston projecting longitudinally of the base to direct pipe in a pushing and assembling procedure. The clamp structure permits lateral stability and positioning of the organization in use.

4 Claims, 4 Drawing Sheets

PIPE PUSHING APPARATUS

BACKGROUND OF THE INVENTION

1. Field of the Invention

The field of invention relates to pipe pushing apparatus, and more particularly pertains to a new and improved pipe pushing apparatus wherein the same is arranged for the stable mounting of the organization within a trench and the like during a pushing procedure.

2. Description of the Prior Art

Various pipe pushing apparatus has been available in the prior art and typically of an elaborate and extensive construction limiting application and use within trenches and the like, or requiring retrofit onto existing vehicles such as in U.S. Pat. No. 3,807,695 to Gremillion, et al.

U.S. Pat. Nos. 4,329,077 to Bouplon; 4,434,969 to Vonruden; and 3,726,506 to VanDerwall, et al. are further examples of pipe pushing structure.

Accordingly, it may be appreciated that there continues to be a need for a new and improved pipe pushing apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of pipe pushing apparatus now present in the prior art, the present invention provides a pipe pushing apparatus wherein the same is readily maneuverable and operative to effect clamping of the apparatus within a trench during a pipe pushing and joining procedure. As such, the general purpose of the present invention, which will be described subsequently in greater detail, is to provide a new and improved pipe pushing apparatus which has all the advantages of the prior art pipe pushing apparatus and none of the disadvantages.

To attain this, the present invention provides an apparatus including an elongate base having a first hydraulic cylinder to pivotally direct clamp members laterally of the base. A second hydraulic cylinder includes a cylinder rod and piston projecting longitudinally of the base to direct pipe in a pushing and assembling procedure. The clamp structure permits lateral stability and positioning of the organization in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pipe pushing apparatus which has all the advantages of the prior art pipe pushing apparatus and none of the disadvantages.

It is another object of the present invention to provide a new and improved pipe pushing apparatus which may be easily and efficiently manufactured and marketed.

It is a further object of the present invention to provide a new and improved pipe pushing apparatus which is of a durable and reliable construction.

An even further object of the present invention is to provide a new and improved pipe pushing apparatus which is susceptible of a low cost of manufacture with regard to both materials and labor, and which accordingly is then susceptible of low prices of sale to the consuming public, thereby making such pipe pushing apparatus economically available to the buying public.

Still yet another object of the present invention is to provide a new and improved pipe pushing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
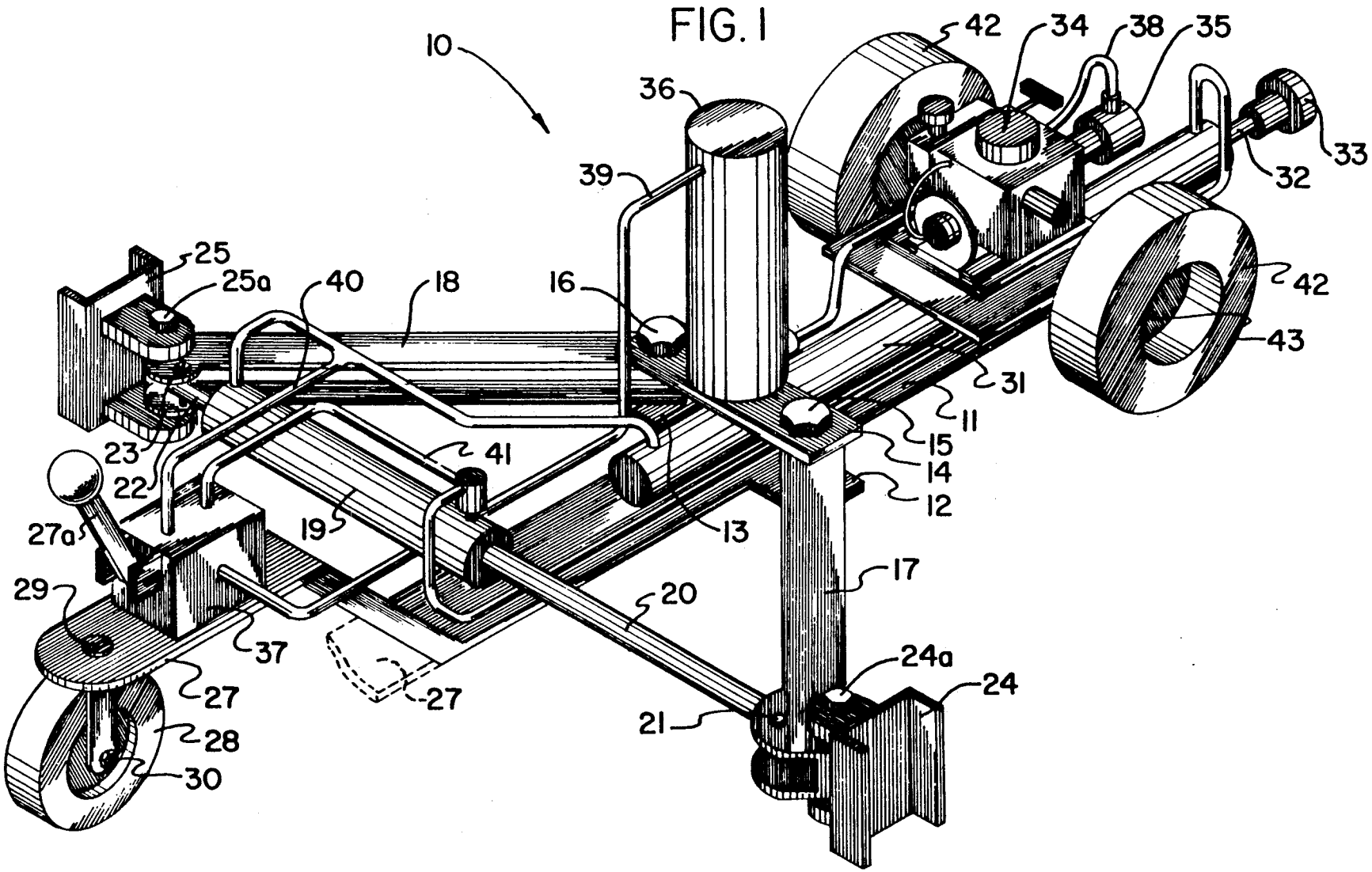
FIG. 1 is an isometric illustration of the instant invention.
Figure 2:
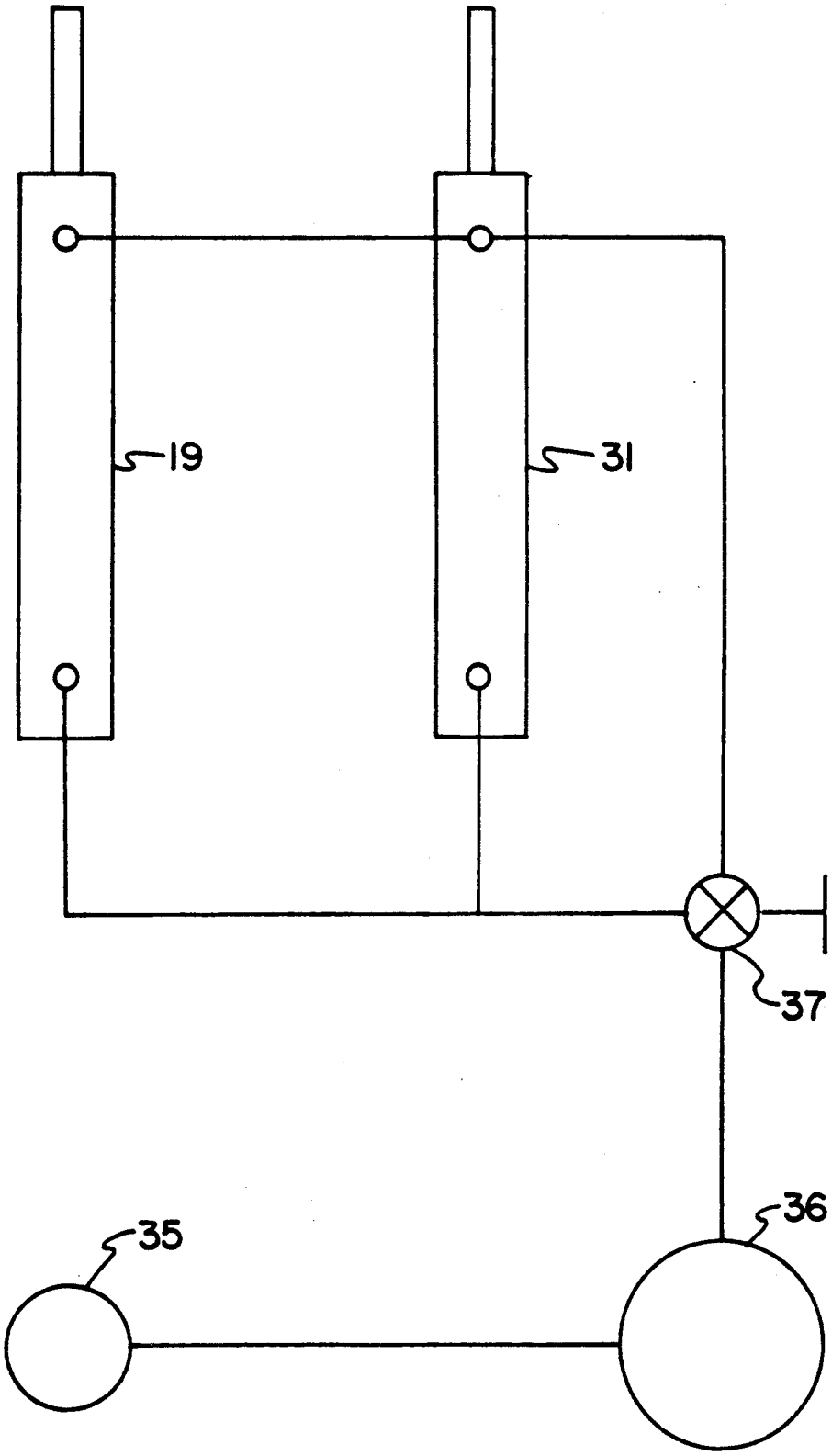
FIG. 2 is a diagrammatic illustration of the hydraulic circuitry of the invention.
Figure 3:
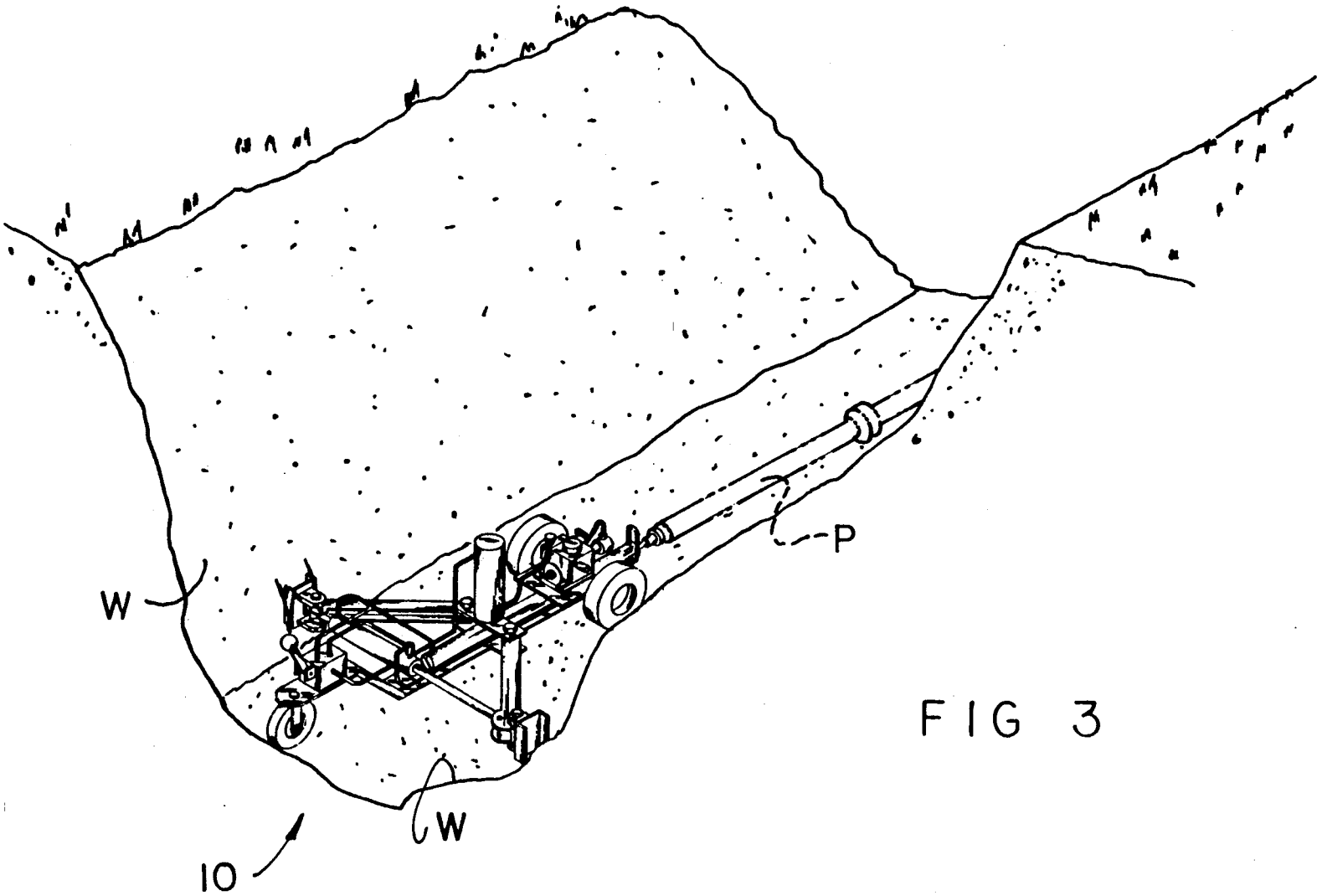
FIG. 3 is an isometric illustration of the invention in use.

With reference now to the drawings, and in particular to FIGS. 1 to 4 thereof, a new and improved pipe pushing apparatus embodying the principles and concepts of the present invention and generally designated by the reference numeral 10 will be described.

More specifically, the pipe pushing apparatus 10 of the instant invention essentially comprises an elongate base plate 11 having a forward end and a rear end at opposed distal ends of the base plate. A first lower flange and a second lower flange 12 and 13 respectively project laterally to opposed sides of the base plate 11, with the first and second lower flanges 12 and 13 coplanar relative to one another and longitudinally aligned. An upper flange plate 14 is arranged parallel to and above the first and second lower flanges extending coextensively therewith having a first pivot axle 15 and a second pivot axle 16 orthogonally directed through the upper flange plate 14 and the first and second lower flange plates 12 and 13 respectively with first and second pivot axles 15 and 16 positioned on opposed sides of the base plate 11 orthogonally oriented thereto. A first clamp arm 17 is pivotally mounted at its first end to the first pivot axle 15, with a second clamp arm 18 pivotally mounted at the second clamp arm's first end to the second pivot axle 16. A free floating hydraulic cylinder 19 orthogonally oriented and above the base plate 11 includes a piston rod 20 longitudinally aligned relative to the cylinder 19 projecting through a forward end thereof, with a hydraulic cylindric support rod 22 coaxially aligned relative to the piston rod 20 positioned fixedly to the cylinder 19 projecting rearwardly thereof. The hydraulic cylinder support rod 22 includes a hydraulic cylinder support rod pivot axle 23 orthogonally mounted to a second end of the second clamp arm 18, with a second clamp jaw 25 pivotally mounted about a second clamp jaw pivot axle 25*a*. Similarly, a forward distal end of the piston rod 20 includes a piston rod pivotal axle 21 pivotally mounted to a second end of the first clamp arm 17. The second end of the first clamp arm 17 further includes a first clamp jaw 24 pivotally mounted thereto about a first clamp jaw pivot axle 24*a*. The pivot axles 24*a*, 21, 25*a*, 23, 15 and 16 are parallel relative to one another.

A steerage wheel support flange 27 extends rearwardly of the rear end of the base plate 11 and may be longitudinally aligned therewith, as illustrated in phantom in FIG. 1, or laterally offset therefrom. A steerage wheel 28 is pivotally mounted about a steerage wheel support pivot axle 29 orthogonally directed through the support flange 27, with the steerage wheel 28 positioned therebelow. The steerage wheel 28 is further rotatably mounted about a steerage wheel axle 30 orthogonally oriented relative to the steerage wheel support pivot axle 29.

A second cylinder, or push cylinder, 31 is mounted to a top surface of the base plate 11 forwardly of the first cylinder or hydraulic cylinder 19. The push cylinder 31 includes a push cylinder piston rod 32 having a piston rod plate 33 mounted to a forward distal end of the piston rod spaced from the push cylinder to effect pushing of a pipe member "P" (see FIG. 3) within a trench bounded by side walls "W". The side walls "W" are simultaneously clamped by the first and second clamp jaws 24 and 25 while pushing the pipe "P", as illustrated.

A drive motor 34 is mounted fixedly relative to the base plate 11 above the second or push cylinder 31. The drive motor 34 effects operation of a fluid pump 35 in fluid communication with a fluid reservoir 36 through a first fluid conduit 38. A valve member 37 operative through a valve member actuator handle 37*a* is in fluid communication with the fluid reservoir 36 via a second fluid conduit 39 and with the first and second cylinders 19 and 31 through a third fluid conduit 40 directed at a first end of each first and second cylinder to extend the associated piston rods 20 and 32. A fourth fluid conduit 41 directed to second ends of the first and second cylinders effects retraction of the piston rods.

It should be further noted that forward support wheels 42 rotatably mounted about forward support wheel axle 43 permit ease of manipulation of the organization as the forward support wheel axle 43 is oriented substantially orthogonally relative to the second cylinder 31.

Figure 4:
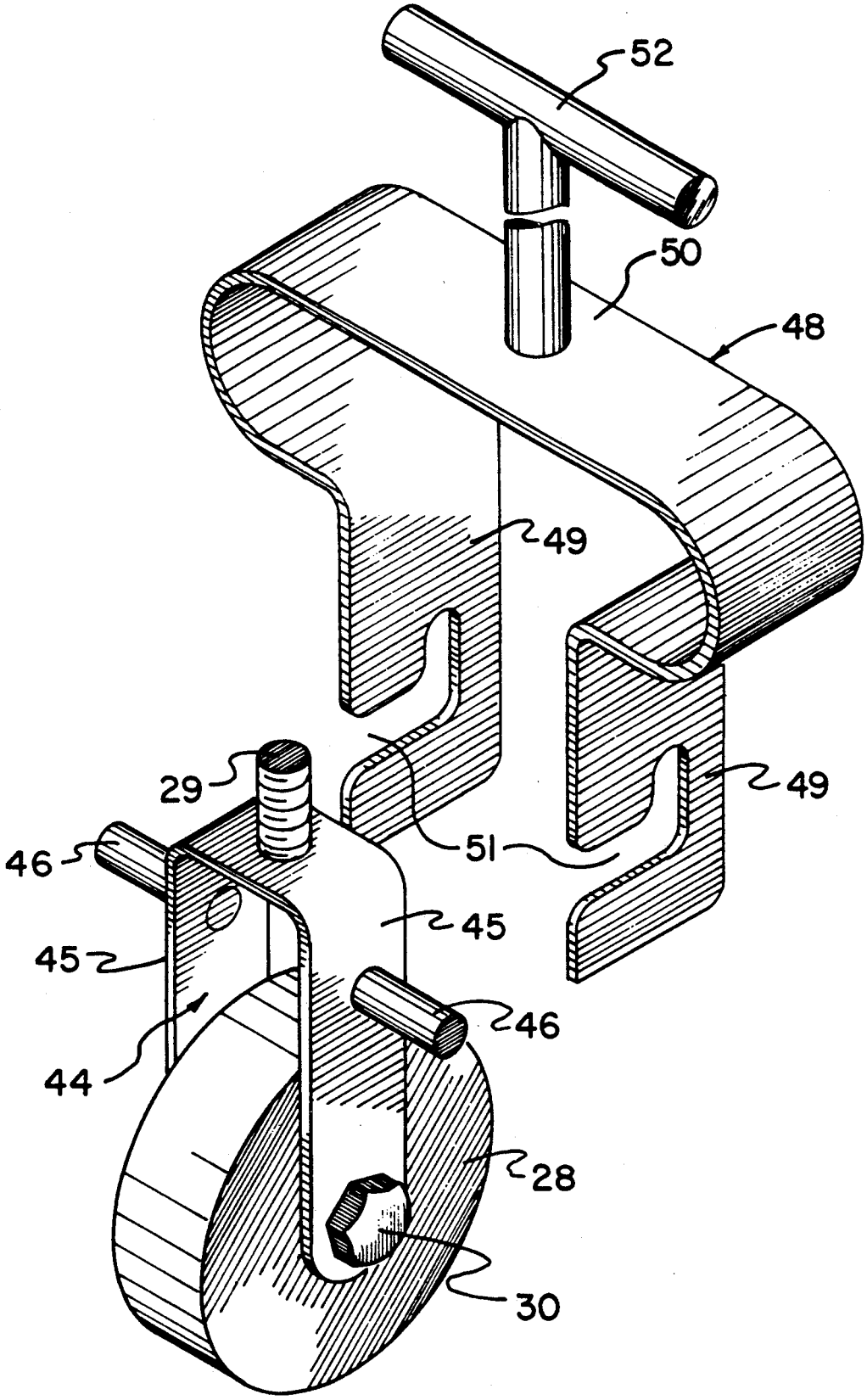
FIG. 4 is an isometric illustration of a steerage bracket optionally utilized by the invention.

The FIG. 4 illustrates the use of a steerage wheel support bracket 48 arranged for mounting to the steerage wheel 28. The steerage wheel 28 includes a steerage wheel U-shaped support bracket 44 having support bracket parallel side legs 45, with the steerage wheel support pivot axle 29 projecting orthogonally upwardly relative to the U-shaped support bracket 44 for projection through the steerage wheel support flange 27, in a manner as discussed above. Side leg rods 46 extend orthogonally in a coaxially aligned relationship relative to one another and orthogonally relative to the side legs 45 projecting exteriorly thereof. The side leg rods 46 are arranged for reception within L-shaped slots 51 formed within steerage bracket side flanges 49. The side flanges 49 each have a parallel planar lower wall projecting upwardly to convex upper walls to define an elongate spacing between the upper walls. The elongate spacing is greater than a predetermined width of the steerage wheel support flange 27 to permit ease of manipulation of the steerage wheel as the support flange 27 is directed through the elongate spacing. Further, it should be noted that the predetermined first spacing between the lower wall portions is greater than a predetermined width of the U-shaped support bracket between the side legs 45. A T-shaped handle 52 is mounted orthogonally and medially of the steerage brackets top flange 50, and in this manner permitting ease of manual manipulation of the steerage wheel 28 in use of the organization.

It should be further noted that the respective fluid conduits 38, 39, 40, and 41, and particularly the conduits 39–41, are flexible to accommodate displacement of the first cylinder or hydraulic cylinder 19 along the base plate upon pivotment of the first and second clamp arms.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A pipe pushing apparatus, comprising, an elongate base plate, the base plate having first wheel members rotatably mounted relative to the base plate, with the first wheel members including a first axle, the first axle arranged parallel to and below the base plate, and the first wheel members positioned adjacent a forward end of the base plate, and a steerage wheel support flange mounted to and positioned adjacent a rear end of the base plate, with the steerage wheel support flange having a steerage wheel pivotally mounted below the steerage wheel support flange and below the base plate, with a steerage wheel bracket having a steerage wheel pivot axle mounted therebetween, with the steerage wheel rotatably mounted about the steerage wheel axle, and a steerage wheel support pivot axle rotatably mounted through and orthogonally directed through the steerage wheel support flange permitting pivotment of the steerage wheel relative to the steerage wheel support flange, and a first cylinder orthogonally oriented relative to and positioned above the base plate adjacent the steerage wheel support flange, and clamp means secured relative to the first cylinder for projecting the clamp means laterally relative to the base plate for clamping opposed side walls of a trench receiving the base plate, and a second cylinder longitudinally aligned relative to the base plate mounted above the base plate in a fixed relationship thereto, with the second cylinder having a second cylinder piston rod, with the second cylinder piston rod projecting forwardly of the base plate forward end for directing pipe members forwardly of the base plate, and hydraulic means selectively operative to effect simultaneous actuation of the first cylinder and the second cylinder.

2. An apparatus as set forth in claim 1 wherein the clamp means includes a first lower flange and a second lower flange mounted to opposed sides of the base plate, with the first lower flange and the second lower flange coplanar relative to one another and with the base plate, and an upper flange plate spaced above and parallel the first lower flange and the second lower flange, with the upper flange plate coextensive with the first lower flange and the second lower flange, and a first pivot axle orthogonally directed through the upper plate and the first lower flange, and a second pivot axle orthogonally directed through the second lower flange and the upper plate, and a first clamp arm having a first clamp arm first end pivotally mounted to the first pivot axle at the first clamp arm first end, and a second clamp arm, the second clamp arm including a second clamp arm first end pivotally mounted to the second pivot axle, and the first cylinder including a piston rod reciprocatingly mounted relative to the first cylinder, with the piston rod including a piston rod pivot axle pivotally mounted to a second clamp arm second end spaced from the second clamp arm first end, and a first clamp jaw, the first clamp jaw including a first clamp jaw pivot axle mounted to the first clamp arm second end, with the first clamp jaw pivot axle, the first pivot axle, and the piston rod pivot axle parallel relative to one another, and a second clamp arm having a second clamp arm first end pivotally mounted to the first pivot axle, and a second clamp arm second end spaced from the second clamp arm first end including a second clamp jaw pivot axle directed therethrough, and the second clamp jaw pivotally mounted relative to the second clamp jaw pivot axle, and the first cylinder including a first cylinder support rod coaxially aligned with the first cylinder and the first cylinder piston rod, and the first cylinder support rod including a first cylinder support rod pivot axle pivotally mounted to the second clamp arm second end parallel to the second clamp jaw pivot axle and parallel to the second pivot axle.

3. An apparatus as set forth in claim 2 including a valve member mounted relative to the base plate in fluid communication with the first cylinder and the second cylinder, and the valve in fluid communication with valve pump means in cooperation with the valve to effect simultaneous projection of the first clamp jaw, the second clamp jaw, and the second cylinder piston rod exteriorly of the base plate.

4. An apparatus as set forth in claim 3 including a steerage bracket, the steerage bracket having steerage bracket side flanges, the side flanges including planar parallel lower walls and each of the planar lower walls including convex upper wall portions defining an elongate spacing, the elongate spacing greater than a predetermined width of said base plate to receive the base plate therewithin, and the steerage wheel support bracket side legs each including a side leg rod, each side leg rod coaxially aligned relative to one another, and the steerage bracket planar lower walls each including an L-shaped slot, and each L-shaped slot receiving one of said leg rods therewithin, and the steerage wheel U-shaped support bracket including a bracket top wall, the top wall including a T-shaped handle fixedly mounted medially of the top wall to permit selective rotation of the steerage bracket and the steerage wheel.

* * * * *